US006502364B2

(12) United States Patent
Richardson

(10) Patent No.: US 6,502,364 B2
(45) Date of Patent: Jan. 7, 2003

(54) SPIGOT PIPE ANCHOR METHOD AND APPARATUS

(76) Inventor: Dwayne E. Richardson, 8211 Alveron La., Orlando, FL (US) 32817

( * ) Notice: Subject to any disclaimer, the term of this patent is extended or adjusted under 35 U.S.C. 154(b) by 0 days.

(21) Appl. No.: 09/896,168

(22) Filed: Jun. 29, 2001

(65) Prior Publication Data

US 2002/0108328 A1 Aug. 15, 2002

Related U.S. Application Data

(60) Provisional application No. 60/268,010, filed on Feb. 12, 2001.

(51) Int. Cl.[7] ..... E04G 21/12

(52) U.S. Cl. ..... 52/745.21; 52/220.8; 52/577; 52/699

(58) Field of Search ..... 52/220.8, 698, 52/701, 576, 577, 699, 745.21; 285/206, 221, 208, 203

(56) References Cited

U.S. PATENT DOCUMENTS

| | | | | |
|---|---|---|---|---|
| 2,065,072 A | * | 12/1936 | Hertzka | |
| 3,318,336 A | * | 5/1967 | Treiber | |
| 4,598,519 A | * | 7/1986 | Reid | 52/246 |
| 4,756,558 A | * | 7/1988 | Beamer | 285/39 |
| 5,509,240 A | * | 4/1996 | Barton, Jr. | 52/220.8 |
| 5,634,311 A | * | 6/1997 | Carlton | 52/577 |
| 5,999,295 A | * | 12/1999 | Merkle | 52/220.8 |

* cited by examiner

*Primary Examiner*—Yvonne M. Horton
(74) *Attorney, Agent, or Firm*—William M. Hobby, III

(57) ABSTRACT

A process for anchoring a water line to a building wall for supporting an attached spigot is the step of selecting a spigot water line anchor having a generally spool shape having a center support member having a pair end flanges attached thereto having an opening slot extending through the spigot water line anchor for sliding over a water line adjacent a spigot in a building wall for supporting the spigot and sliding the selected spigot water line anchor over a water line adjacent a spigot within the wall of a building having each anchor flange extending over adjacent opposite sides of a building wall for supporting the water line and spigot.

2 Claims, 1 Drawing Sheet

SPIGOT PIPE ANCHOR METHOD AND APPARATUS

This Application claims the benefit of Provisional Application No. 60/268,010, filed Feb. 12, 2001.

BACKGROUND OF THE INVENTION

The present invention relates to a process and apparatus for anchoring a water line to a building wall for supporting an attached spigot.

Outdoor spigots or bibcocks are usually attached to a water line extending from a building wall. The spigot or bibcock is typically attached by soldering to a copper pipe. The end of the water line may also have a threaded coupling for attaching a spigot thereto and may also be attached to PVC water lines. In the construction of a building, the water line is run to the position on the building wall where a spigot is desired and then run through the wall. In the case of a masonry type wall, the masonry has to be cut out to leave an opening for the pipe to extend through. It has also been common in the past to support water lines within the building walls of a building. This is commonly done with various types of strapping made to fit around a water line which is anchored to a wall stud or the like. Steel strapping is often used to anchor a pipe to a wall and sometimes is formed to support a pipe with a hanging strap.

The present invention is directed towards a process of anchoring a water line to a building wall adjacent where a spigot is attached to the water line and utilizes a prefabricated water line anchor having a generally spool shape designed to slip over a water pipe of a predetermined size with the flanges of the spool shape fitting on opposite sides of the wall.

SUMMARY OF THE INVENTION

A process for anchoring a water line to a building wall for supporting an attached spigot includes selecting a spigot water line anchor having a generally spool shape having a center support member and a pair end flanges attached thereto having an opening slot extending through the spigot water line anchor for sliding over a water line adjacent a spigot in a building wall for supporting the spigot. The selected spigot water line anchor is slid over a water line adjacent a spigot within the wall of a building having each anchor flange extending over adjacent opposite sides of a building wall for supporting the water line and spigot.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
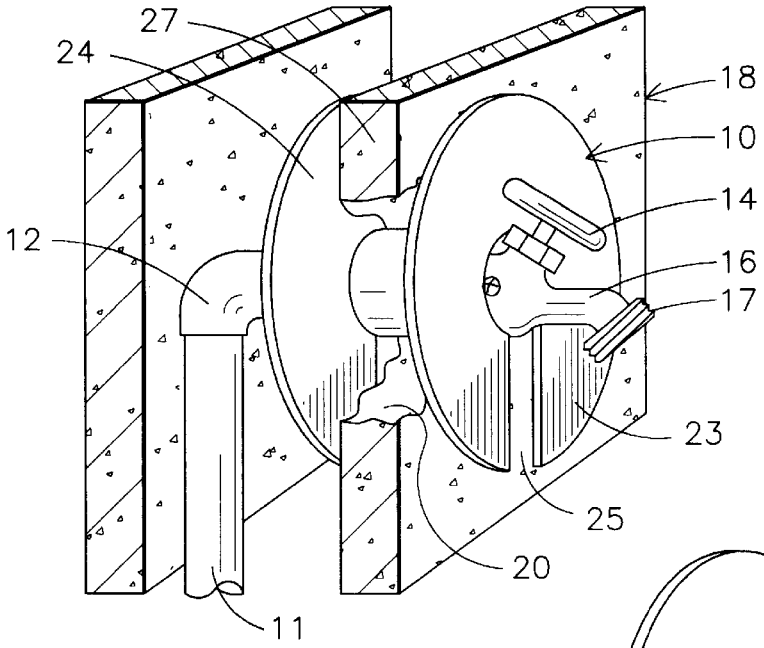
FIG. 1 is a perspective view of a wall section having a spigot pipe anchor anchoring a water line to the wall adjacent the spigot.
Figure 2:
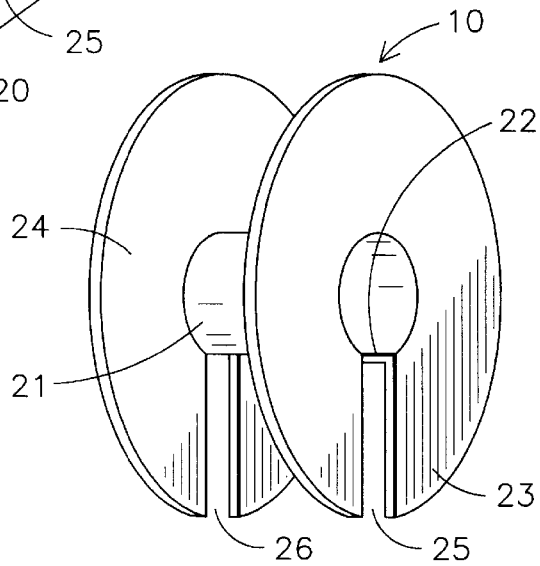
FIG. 2 is a perspective view of the spigot pipe anchor of FIG. 1.
Figure 3:
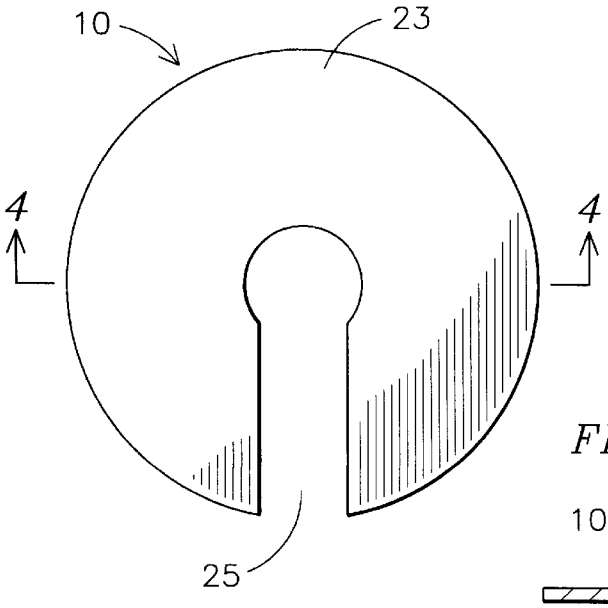
FIG. 3 is a top elevation of the spigot pipe anchor of FIGS. 1 and 2.
Figure 4:
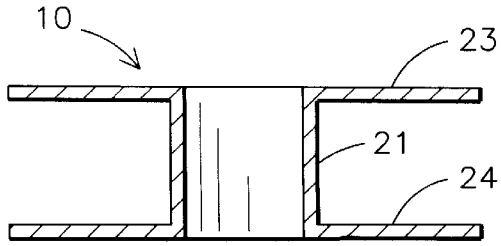
FIG. 4 is a sectional view taken on the line 4—4 of FIG. 3.

Referring to the drawings, a spigot pipe anchor 10 is attached over a water line 11 inside the elbow 12 and adjacent the spigot 13. The spigot, also referred to as a faucet, tap or bibcock, includes a handle 14 attached to the valve stem 15 adjacent the faucet body 16. The faucet body has a water outlet 17. The spigot pipe anchor 10 is shown supporting the pipe 11 to a building wall 18 which has the water line 11 thereinside and which wall has an opening 20 cut into the edge of a concrete block. The building wall 18 is illustrated in the form of a concrete block which has had the cutout 20 busted thereinto, as typical in concrete block construction. The spigot pipe anchor 10 has a pipe or water line supporting member 21 which is generally cylindrically shaped having a slot 22 cut the length thereof. There is a first flange 23 on one end of the support member 21 and a second flange 24 on the other end thereof to form a generally spool shape pipe anchor. The flange 23 has a slot 25 cut therein and aligning with the slot 22 in the support member 21. Flange 24 has a slot 26 therein which also aligns with the elongated slot 22. The elongated slots 22, 25, and 26 form a yoke which allows the spool shaped spigot pipe anchor 10 to be slid over a water line. The spigot pipe anchor 10 may typically be made of a polymer which allows the sides to expand while sliding over a water line 11. As shown in FIG. 1, the spigot pipe anchor 10 has been slid over a water line extending through the concrete block 18 which has had an opening cut from one end. The spool shaped anchor can then be slid in from side 27 over the water line and then rotated as shown in FIG. 1. The cutout edge 20 in the wall 18 can then be sealed with concrete as the wall is being built. The spigot 13 can then be attached to the end of the water line 11.

The process for anchoring the water line 11 to a building wall 18 for supporting an attached spigot 13 includes selecting a spigot water line anchor 10 having a generally spool shape with a center support member 21 and a pair of end flanges 23 and 24 and having slots 25, 26, and 22 extending therethrough for sliding the anchor over a water line 11 and then sliding the selected spigot water line anchor 10 over a water line 11 adjacent a spigot 10 within the wall of a building with each anchor flange 23 and 24 extending on opposite sides of the building exterior wall portion 18 for supporting a water line adjacent a spigot. The spigot water line anchor can be made of a polymer as one piece and supports the water line and the spigot.

It should be clear at this time that a spigot pipe anchor for supporting a water line to a building wall and a process for anchoring a water line to a building wall for supporting an attached spigot has been provided which can be easily manufactured and utilized in the construction of a new building. However, it should also be clear that the present invention should not be construed as limited to the forms shown which are to be considered illustrative rather than restrictive.

What is claimed is:

1. A process for anchoring a water line to a building wall for supporting an attached spigot comprising the steps of:

selecting a spigot water line anchor having a generally spool shape having a center support member having a pair of end flanges attached thereto and having an opening slot extending through said spigot water line anchor for sliding said anchor over a water line; and sliding said selected spigot water line anchor over a water line adjacent a spigot within the wall of a building having each said anchor flange extending adjacent opposite sides of said building wall for supporting said waterline adjacent a spigot.

2. A process for anchoring a water line to a building wall for supporting an attached spigot in accordance with claim 1 in which said selected spigot water line anchor is a one piece polymer spigot water line anchor.

* * * * *